US006700042B1

(12) United States Patent
Huang

(10) Patent No.: US 6,700,042 B1
(45) Date of Patent: Mar. 2, 2004

(54) STRUCTURE OF SPRING DRIVING MUSICAL MOVEMENT

(75) Inventor: Lung-Hsi Huang, Dail (TW)

(73) Assignee: Kyooh Precision Industry Co., Ltd., Taichung (TW)

( * ) Notice: Subject to any disclaimer, the term of this patent is extended or adjusted under 35 U.S.C. 154(b) by 0 days.

(21) Appl. No.: 10/413,949

(22) Filed: Apr. 15, 2003

(51) Int. Cl.[7] ..... G10F 1/06

(52) U.S. Cl. ..... 84/94.1

(58) Field of Search ..... 84/94.1, 94.2, 84/95.1, 95.2, 96, 97, 98, 99, 100

(56) References Cited

U.S. PATENT DOCUMENTS

| | | | | | |
|---|---|---|---|---|---|
| 4,890,528 | A | * | 1/1990 | Kamijima | 84/95.2 |
| 6,204,439 | B1 | * | 3/2001 | Chen | 84/95.2 |
| 6,300,548 | B1 | * | 10/2001 | Zhu et al. | 84/94.1 |
| 6,576,821 | B1 | * | 6/2003 | Chen | 84/95.1 |

* cited by examiner

*Primary Examiner*—Kimberly Lockett
(74) *Attorney, Agent, or Firm*—Apex Juris, pllc; Tracy M Heims

(57) ABSTRACT

A kind of improved structure of spring driving musical movement, which includes a set of musical base, a set of speed reducer and an upper cover principally. Putting two concave shape grooves which are on the musical movement base into a bilateral gear perpendicularly, then evoke parallel into the shaft ends of a step spur gear by the U shape groove on the base and the top frame of an inverse L shape shaft, then assemble a crown gear, a rotary shaft, then combine a worm with a speed reducer to form a set of speed reducer set commonly, and then, after put the lower shaft end of the worm of the speed reducer set into the locating hole of the lower shaft end of the worm of the musical movement base, cover the spring cover, will lead the upper shaft end of the worm of the speed reducer set into the locating hole of the worm of the spring cover, then rivet the spring cover with musical movement base; the worm of the speed reducer set will rotate and the S shape friction plate of the worm will rotate simultaneously by tight the spring to drive the musical movement making runner gear assemble, the two sides of S shape friction plate will open parallel by the centrifugal force to frictionize all of the interior side of the ⊓ shape cylinder cover of the spring cover, it will get effect to reduce speed, balance windage and decrease noise, the playing speed of the musical movement will approach to stable, and the noise will be more improved.

2 Claims, 5 Drawing Sheets

STRUCTURE OF SPRING DRIVING MUSICAL MOVEMENT

BACKGROUND OF THE INVENTION

1. Field of the invention

The invention about the improvement structure of spring driving musical movement, especially refer to the set-up on the musical base, and mount a speed reducer which is formed as one on the down side of the base, assemble together in the ⊓ shape cylinder cover of the spring cover, this is the new structure of the musical movement.

2. Description of the Prior Art

Usually, the principal constructive features of the structure of the spring driving Musical movement are: the structure show as in FIG. 1, which with single support frame but apart from spring cover; the construction of the support frame set is combined by a step spur gear 12 which drives a bilateral gear 13, meanwhile a worm 14 which mounted a windage case which can be used as switch brake 15 on the top, on the most top has a frictionized set 16 and support frame 17.

When rotate the spring of the musical movement tightly, the worm 14 will rotate clockwise by the transmission of the gear, at the same time the windage set which can be used as switch brake 15 will rotate too, meanwhile two wings of the windage set which can be used as switch brake will open and fly up and rotate, but two convex points 18 of upper side of the windage which can be used as switch brake will frictionize the down edge of the friction set 16, will get the purpose of reducing speed. The defects of this kind of structure are (1) There have four components of the speed reducer set, the material cost is high and waste time to assemble.

(2) After mounting step spur gear 12 into support frame 17 must rivet the shaft bracket 19 of the support step spur gear to fix spur gear 12 by processing way, will waste work time.

(3) The windage set which can be used as switch brake 15 is easy to deform, the convex 18 on the windage set which can be used as switch brake and the frictionized set 16 will produce noise by the unbalance rotational friction.

When every windage set which can be used as switch brake 15 of the musical movement combine with the worm 14, the position is hard to locate; if the position of the windage set which can be used as switch brake 15 is too high, when musical movement play, because of two wings of the windage set which can be used as switch brake will open to rotate, the friction resistance of convex point 18 and frictionized set 16 will be too large, it will cause the playing speed of the musical movement too slow; when the position of the windage which can be used as switch brake is too low, the friction resistance between convex point 18 and frictionized set 16 will be too small, it will cause the playing speed of the musical movement too fast;

So, if want this type of musical movement in assemble process play music in normal speed, it must check the play speed one by one, and most of all must adjust the position of the windage set which can be used as switch brake 15 suitably, it will waste large of assembly work time; and if user touch the windage which can be used as switch brake 15 carelessly, the position will move, cause the playing speed of the musical movement is not good; and when fixing the step spur gear 12 in the support frame 11 must rivet the shaft bracket 19 of support step spur gear by processing, it will waste assembly work time and when processing will easy to produce variables, make the structure to produce disorder.

As FIG. 2 shows another kind of musical movement structure, which assemble by the extended part of spring cover; the speed reducer is composed of a worm 21, therein assemble a windage which can be used as switch brake 22, put the low shaft end of the worm 21 of this speed reducer set into the locating hole 23 of the worm of the musical movement base, mount the bilateral gear 24 and step spur gear 25 in musical movement base 26, then cover the spring cover 27, the extended shaft 28 of spring cover 27 can suit to compress a step spur gear 25, meanwhile, the up end of the shaft of the worm 21 lead to the locating hole of the worm of the spring cover's extended part, the down end of the shaft mount to the down side locating hole of the worm 21 of the base, and then rivet spring cover 27 with base. Compare this kind of speed reducer structure with the speed reducer structure shows in FIG. 1, the merits and defects are:

(1) The components of the speed reducer set are only two pieces, compare it with the structure of FIG. 1, the material cost is low.

(2) The step spur gear 25 must be fixed by the extended shaft 28 of the spring cover 27, it will affect the model, break the beautiful view of the whole.

(3) The locating hole set of the worm locating hole 23 on musical movement base 26 is flat, adding lubricant oil is finite and easy to flow out, it will affect the configuration.

(4) The windage which can be used as switch brake 22 has the same form as show in FIG. 1, it easy to deform, the defect of leading unbalance rotating friction to produce noise is the same of the form in FIG. 1.

(5) The defect of hard to locating alignment of assemble the windage which can be used as switch brake 22 of every musical movement with worm 21 leading to the problem of adjustment and stability of playing speed is the same problem mentioned in the type of FIG. 1.

Another type of speed reducer structure of spring driving musical movement as shows in FIG. 3, its structure is similar to the type of FIG. 1, with single support frame but apart from spring cover. The step spur gear 33 of the support frame set 31 is assembled in the same way as FIG. 1, the difference is the structure of speed reducer, the components increase from four to five pieces, windage set change to friction set 34, and is independent of switch brake 35. The shape of friction set 34 is 3-claws circular, the frictionized set is ⊓ shape cylinder 36, the way of reduce speed is by the lateral side of the friction set open and rotate parallel to frictionize with the interior side of the ⊓ shape cylinder, it is differ from FIG. 1 and FIG. 2 frictionize upper side.

The components of the speed reducer on the musical movement structure are, a screw 37, assemble the switch brake 35 close fit into the top of worm of screw 37, then assemble a 3-claws circular friction set 34, mount the 3-claws circular friction set of the speed reducer set into the ⊓ shape cylinder cover 36 which is combined with support frame 32, the down end of the shaft of the screw 37 is mounted on the predict locating body of the worm of the support frame. Comparing this type of speed reducer construction with the type show in FIG. 1 and FIG. 2 the merits and defects are:

(1) The components of the speed reducer set have 5 pieces, material cost is the highest, the components in assembly is the most, waste time to assemble.

(2) When mount step spur gear 33 on the support frame 32, need rivet support frame 32 by processing to fix the spur gear 33, will waste work time.

(3) The locating of 3-claws circular friction set is decided by the precision of the switch brake locating, the defect of every musical movement hard to locate is the same as in the types of FIG. 1 and FIG. 2.

Although the friction way of friction set and ⊓ shape cylinder is laterial parallel opening rotary friction, but the form of the friction set is 3-claws, multiple points friction, it is hard to balance consistently, although the noise is less than the type in FIG. 1 and FIG. 2, but it is still hard to get ideal effect.

(4) The design of 3-claws circular friction set can't combine with switch brake to form in one.

So, we can see, the conventionally used musical movement structure, no matter how considering the cost or quality there still have many defects, they are not good design, must be improved.

The inventor of this case saw the defects of the conventionally used structure of spring driving musical movement, want to improve them by his mind, after long time research, finally invent this new design and improvement of the spring driving musical movement structure successfully.

SUMMARY OF THE INVENTION

The principal purpose of this invention is to supply a kind of improved structure of spring driving musical movement, to improve the defects and bottleneck on cost and quality of the conventionally used spring driving musical movement; That assembles the components quickly and simply, besides insure the engineer quality of the musical movement, the playing speed more approach stable and more decrease the noise of the speed reducer, it can save the assembly time, promote the production effect effectively, and cost down the production cost very much.

Another purpose of this invention is to supply a kind of improved structure of spring driving musical movement base, by the matching of U-shape groove and inverse L-shape shaft top frame, evoke two shaft ends of a step spur gear, when the tightly spring drive the musical movement to play, can match to rotate by the transmission of the gear set, it brings the speed reducer to rotate too, and it brings the S-shape friction set on the worm to make rotary motion, the two sides of S-shape friction set will open parallel by the centrifugal force to frictionize all of the interior of the ⊓-shape cylinder cover of the spring cover, to get the purpose of reduce speed, balance windage, decrease noise.

The achievement of the purpose of the prescribed new type structure improvement of musical movement, is combined by a musical movement base, a speed reducer set, a spring cover and a gear set.

A musical movement base, there are two concave shape grooves on the musical movement base, which can mount a bilateral gear perpendicularly, set a U-shape groove and a inverse L-shape shaft top frame on the up side, can evoke a step spur gear parallel into inverse L-shape shaft top frame to fix, will not slip, and when musical movement play, step spur gear will approach to fly up by the engagement of every gear, it will keep position to rotate by the compression of the inverse L-shape shaft top frame; at down side of the base set a locating hole and locating hole set of the down end shaft of a worm, locating hole supply the function of fixing of the down end shaft of the worm, and locating hole set is cup shape, can save the lubricant oil.

A speed reducer, including a worm, on the top of the worm with a concave groove, the concave groove can go through the center circular hole of the speed reducer, a helical tooth mounts on the down side of the worm, the helical tooth connect with the bilateral gear; a speed reducer, is S-shape friction set and switch brake which is form to one by soft plastic or rubber material, the switch brake is formed by the intermediate rib which extend to two sides of the S-shape friction set, there are a big and a small interior holes go through each other on the center of the speed reducer, the diameter of the big hole close fit with the diameter of the worm, and the diameter and depth of the small hole close fit with the diameter and width of the concave groove on the worm;

A spring cover, is mounted on the relative place of the prescribed musical movement base, another including of the spring cover is: a spring cover and a ⊓-shape cylinder cover which is extended to form by one, the ⊓-shape cylinder cover set a locating hole of the up end shaft of the worm, which supply the function to fix the up end shaft of the worm; another including of the gear set are: a crown gear; a bevel wheel; a bull gear; a cylinder with multiple convex points; a radial fin type elastic plate; and a spring.

BRIEF DESCRIPTION OF THE DRAWINGS

Please refer to the description of the drawings of the preferred practice example about this invention will understand the technical content and the purpose effect of this invention progressively; the drawings are.

DETAILED DESCRIPTION OF THE PREFERRED EMBODIMENT

Figure 1A:
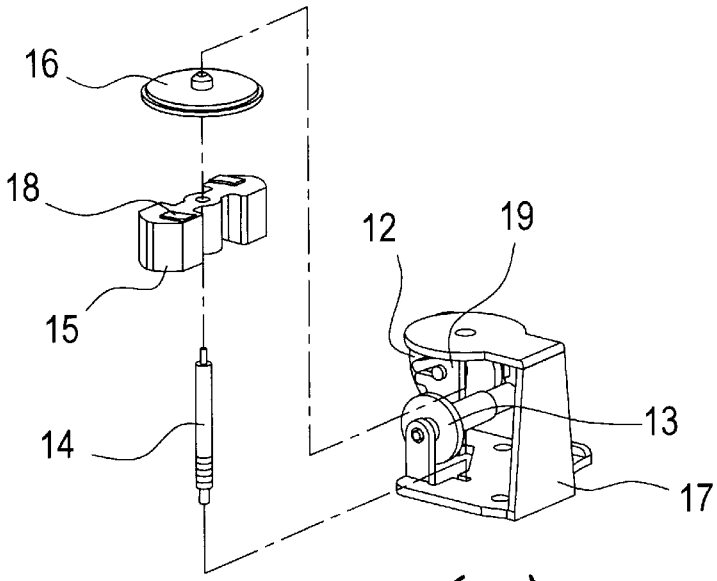
FIG. 1, FIG. 2, FIG. 3 are the analytic drawings of the conventionally used spring driving musical movement structure.
Figure 1B:
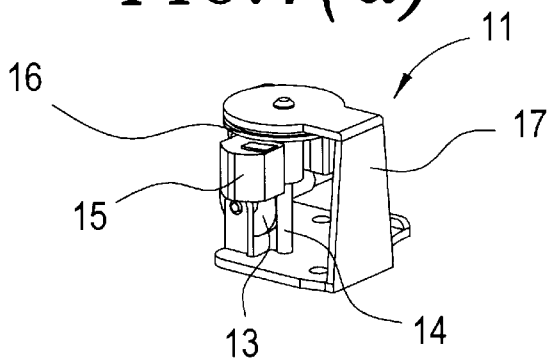
Figure 1C:
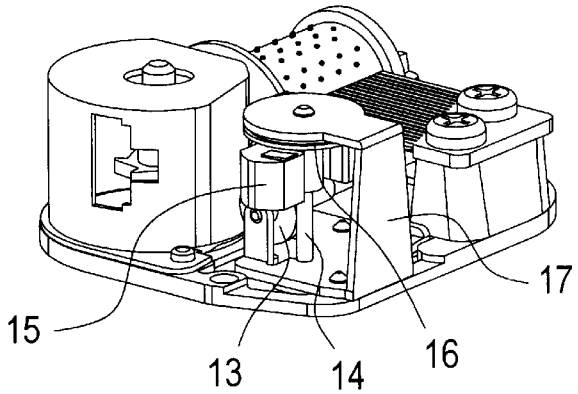
Figure 2B:
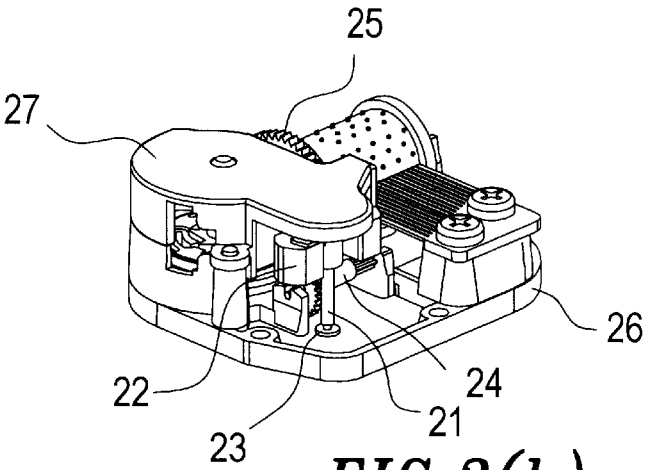
Figure 2A:
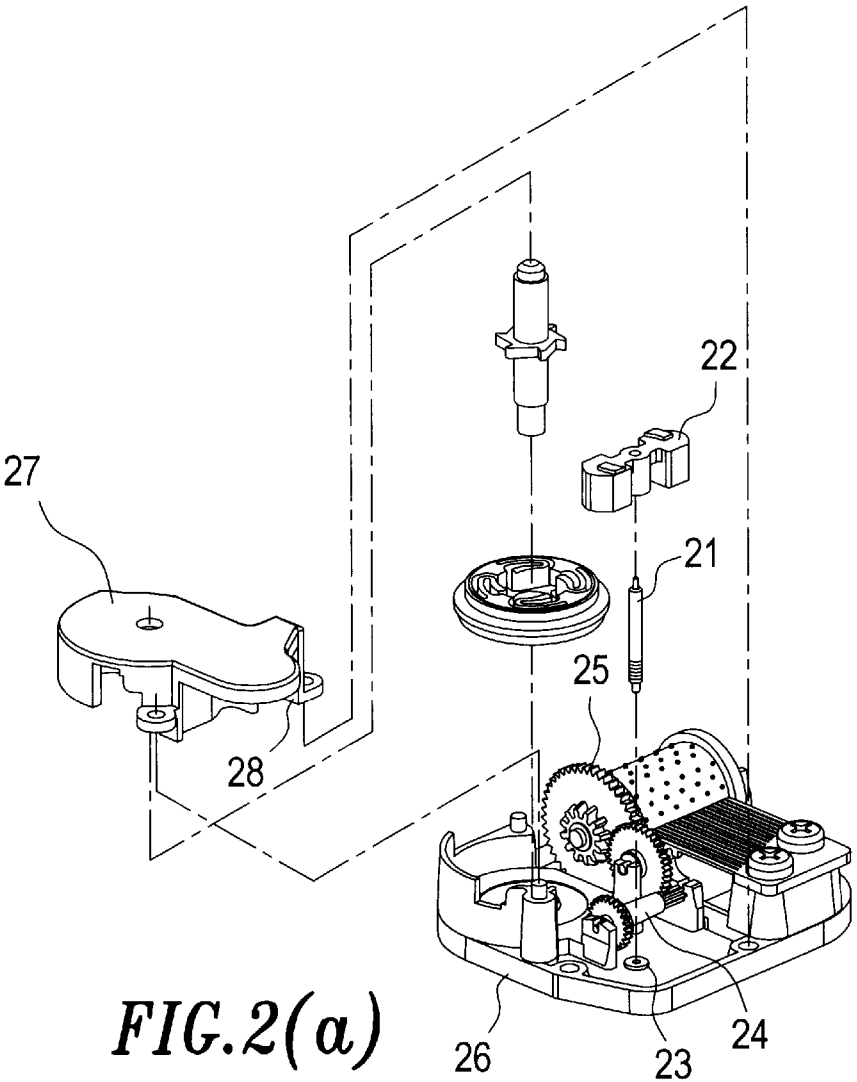
Figure 3A:
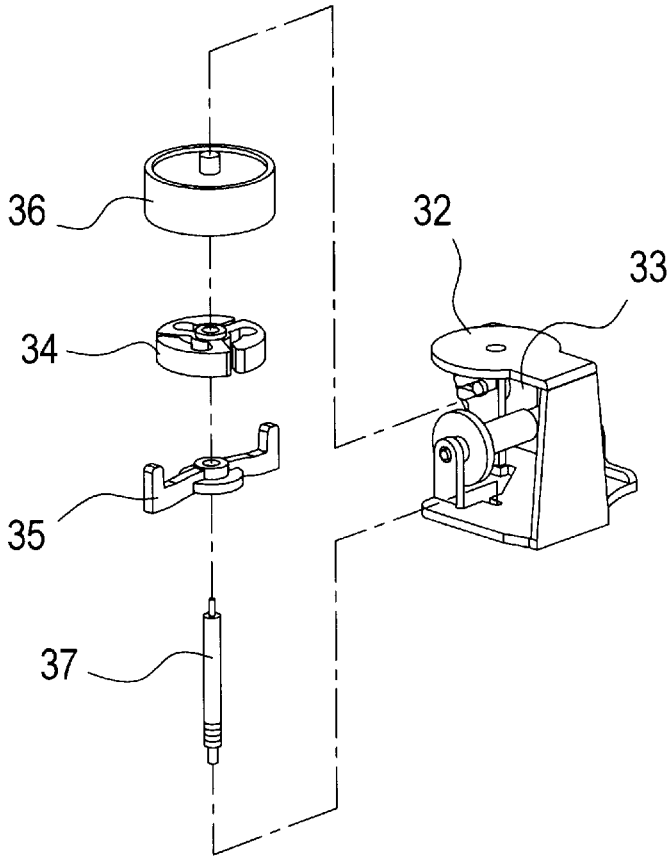
Figure 3B:
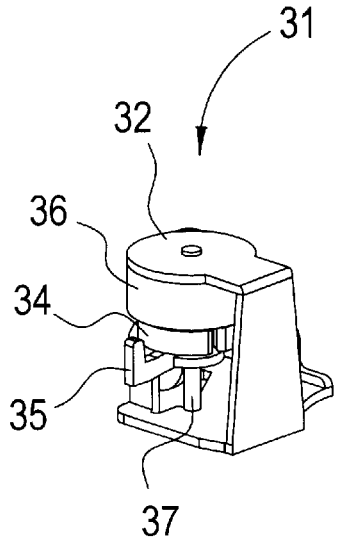
Figure 3C:
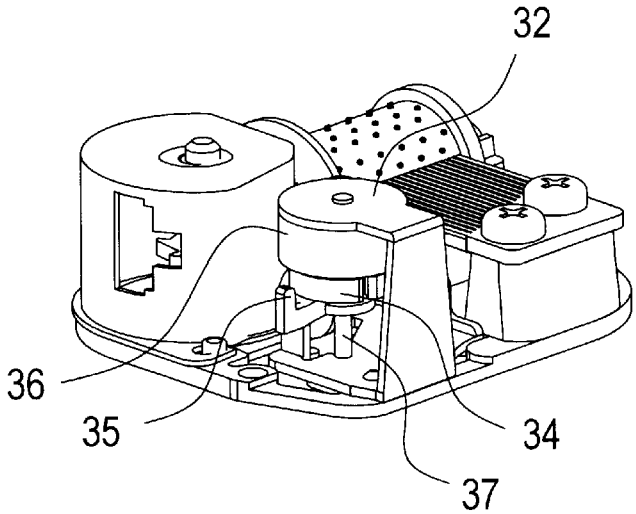
Figure 4:
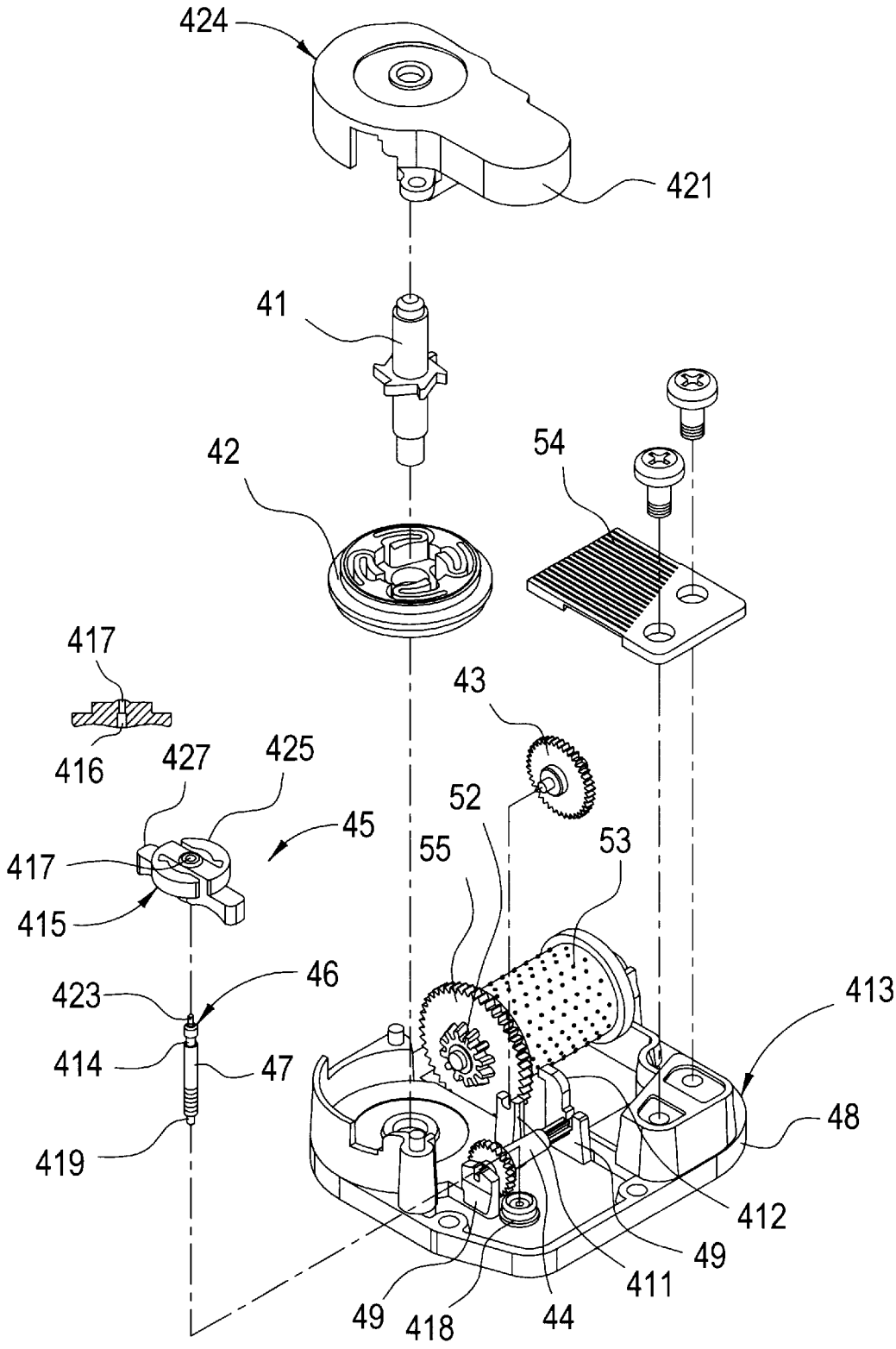
FIG. 4 is the analytic drawings of the improved structure of the spring driving musical movement of this invention.
Figure 5A:
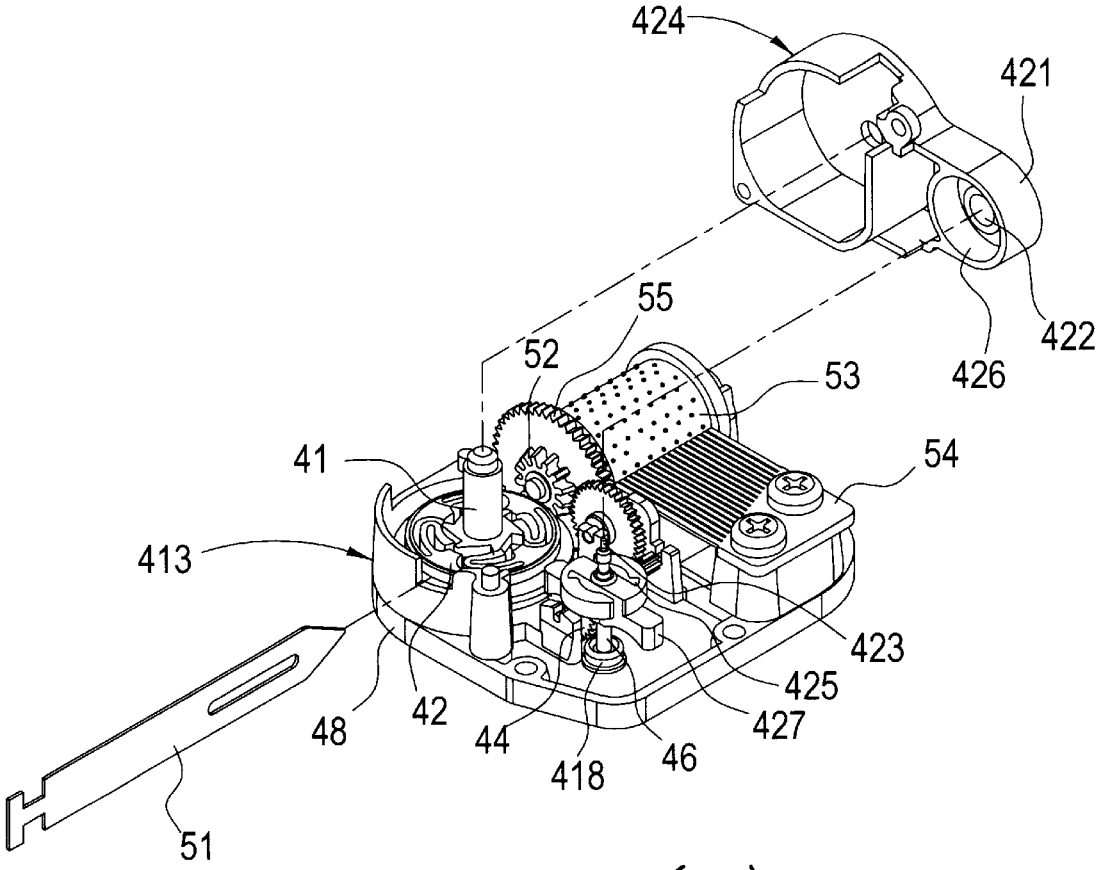
FIG. 5 is the explosion diagrams of the preferred practice example of the improved structure of the spring driving musical movement of this invention.
Figure 5B:
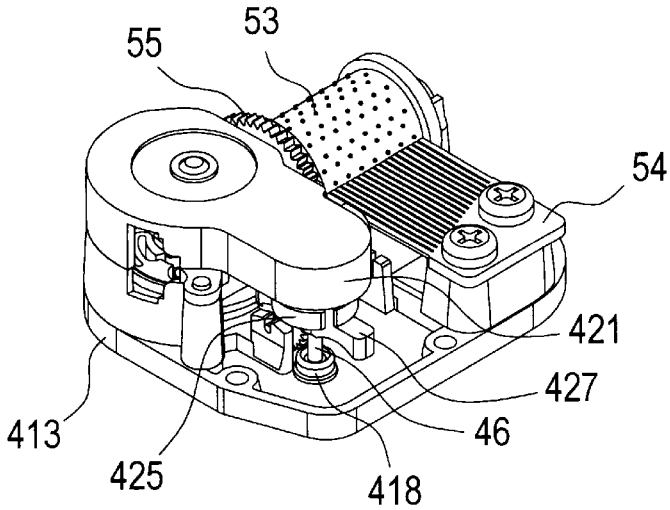

Please refer to FIG. 4, FIG. 5, which is the preferred embodiment of spring driving musical movement improved structure of this invention, principally include: a musical movement base, a speed reducer set, a spring cover, a spring, and a gear set.

When the rotated shaft 41 rotating clockwise will move the spring 51, the rotated shaft 41 will bring the crown gear to rotate after turn the spring 51 tightly, then the crown gear 42 move the bevel wheel 52, the cylinder 53 with multiple convex points which connects with the bevel wheel 52 will rotate by the work of bevel wheel 52, meanwhile, the top end of the radial fin type elastic plate 54 just can touch the multiple convex points on the cylinder 53, making the radial fin type elastic plate to issue beautiful music.

At the time when the rotary shaft 41 move crown gear to rotate, then crown gear 42 move a bevel wheel 52, and bull gear 55 move a step spur gear 43 to rotate too, and then work a bilaterial gear 44 by the step spur gear 43, the bilaterial gear 44 drives the helical tooth 47 which is mounted on the down side of the worm 46 of the speed reducer set 45 to rotate.

Beneath will make a detailed description about the combined process of the spring driving musical movement improved structure of this invention, mount a bilaterial gear 44 perpendicularly by two concave shape grooves 49 on the musical movement base 48, the U-shape groove 411 on the base and the inverse L-shape shaft top bracket 412 can evoke parallel into the two end shaft of the step spur gear 43, a crown gear 42 and a rotary shaft 41 were mounted on the circular hole side of the top side of the base to form a musical movement base set 413, then by setting a concave groove 414 on the top of worm 46 of the speed reducer set 45, and the concave groove 414 can mount through the interior hole of the speed reducer 415, the hole diameter 416 of the big interior hole of the speed reducer 415 and the outer diameter of the worm 46 close fit each other, the hole diameter and depth of the small interior hole 417 close fit each other with the outer diameter and depth of the concave groove 414 on the worm 46, by setting a locating hole 418 of the down end of the worm on the musical movement base set 48, can mount the worm lower end shaft 419 of the worm 46, and then by setting a worm top end shaft locating hole 422 on the ⊓-shape cylinder cover 421 to mount the top end shaft 423 of the worm alignment, and cover the spring cover 424 to lead the top end shaft 423 of the worm into the ⊓-shape cylinder cover 421, and the lower end shaft 419 of the worm mounts into the locating hole 418 of the lower end shaft of the worm of the base, and the S-shape friction plate 24 of the speed reducer 46 can hide completely in the ⊓-shape cylinder cover 421, and then rivet spring cover 424 with musical movement base set 48.

The S-shape friction plate 425 of the speed reducer 415 will open parallel to rotate simultaneously when the speed reducer set rotate, the S-shape friction plate 425 will frictionize all of the interior side 426 of the ⊓-shape cylinder, the inside diameter 426 of the ⊓-shape cylinder cover is larger than the outer diameter of the S-shape friction plate 425, the difference between the inside and outer diameter is decided by the friction force which is produced by the two side of the S-shape friction plate 425 open parallel to rotate when the musical movement work, and match to control the playing speed of the musical movement, the switch brake 427 of the speed reducer 415 will follow the S-shape friction plate 425 to rotate at the same speed, it will balance windage, decrease noise when the switch brake 427 rotate.

The improved structure musical movement which supplied by this invention compare with the conventionally structure technical of musical movement with the merits in beneath:

1. The design of the U-shape groove and the inverse L-shape shaft top bracket on the musical movement base is convenient for the two end shaft of the step spur gear to evoke parallel will achieve stable of the rotate speed and work function without by rivet processing, it will save the work time and cost of the second processing; and the cup type locating hole set of the lower end shaft of the worm mounted on the other side of the base can supply suitable lubricant oil to save will extend the life of lubrication function of the worm.
2. The design of the worm concave groove of the speed reducer set can make the S-shape friction plate and switch brake of the speed reducer which form in one of every musical movement to locate alignment, will make the playing speed of every musical movement to approach stable, save the time of check in assembly process and adjustment of the playing speed, and the user will not touch the speed reducer cause by without careful to move to position of the speed reducer to cause defect of the playing speed of the musical movement.
3. The ⊓-shape cylinder cover extend from spring cover to form in one will save the components of frictionized plate and support frame.
4. Soft plastic or rubber use for S-shape friction plate and switch brake to form in one can decrease components, cost down material cost and work time of assembly.
5. The design of S-shape friction plate which frictionizes with the ⊓-shape cylinder cover is by the two side of the friction plate to open parallel to rotate when the musical movement work, and will frictionize all of the interior side of the cylinder to achieve the effect of decrease speed and lower down noise, help to balance windage.

The improved structure of musical movement supplied by this invention will simply the components and is convenient to assemble, more easy to assure engineer quality, more save the time of assembly process, can promote the production effect effectively, cost down the production cost very much.

Summarize the statement above, this case is not only belong to new style in spatial type but can promote multiple effects state above compare with conventional object, it should de suitable for the points of new type pattern applicant in novel and progressive, so apply by the laws, please the bureau can approve the new style pattern applicant to excite creation, I will be very thankful.

What is claimed is:

1. A kind of improved structure of spring driving musical movement which principal features of the structure includes:

a musical movement base set, setting up two concave grooves on the musical movement base set which can mount a bilaterial gear perpendicularly, setting up a U-shape groove and an inverse L-shape shaft top bracket on the up side, evoking the two end shaft of a step spur gear into said inverse L-shape shaft top bracket means for fixing, a locating hole set of the lower end shaft of a worm being mounted on the down side of said base set, the locating hole supplying the function for the lower end shaft of said worm means for fixing, and said locating hole set being a cup shape means for saving lubricant oil;

a speed reducer including said worm, setting up a concave groove on the top of said worm, the concave groove mounting through the center circular hole of said speed reducer, setting up a plurality of helical teeth on the lower side of said worm, said helical teeth connected with a bilateral gear; said speed reducer being a S-shape friction plate and a switch brake which formed in one by soft plastic or rubber material; said switch brake being formed by the extended two sides of the intermediate rib of said S-shape friction plate, a big and a small diameter of interior holes through each other on the center of said speed reducer, the big hole diameter close fitting with the outer diameter of said worm each other, and the small hole diameter and depth close fitting each other with the outer diameter and width of the concave groove on said worm;

a spring cover mounting on the relative position of top side of said musical movement base, said spring cover including: said spring cover and a ⊓-shape cylinder cover which is extended by form in one, a locating hole of the top end shaft of said worm being mounted in said ⊓-shape cylinder cover with function for top side of said worm means for fixing;

a gear set including a crown gear, a bevel wheel, a bull gear, a cylinder with multiple convex points, a radial fin type elastic plate, and a spring.

2. A kind of improved structure of musical movement as claim 1, therein the inner diameter of said ⊓-shape cylinder cover being bigger than the outer diameter of said S-shape friction plate, the difference of the inner and outer diameter decided by the magnitude of friction force which is produced by the two sides of S-shape friction plate opening parallel to rotate when said musical movement work, then matching the playing speed of said musical movement.

* * * * *